US008545176B2

(12) United States Patent
Willis

(10) Patent No.: US 8,545,176 B2
(45) Date of Patent: Oct. 1, 2013

(54) WOBBLE PLATE MOTOR

(76) Inventor: Jerry F. Willis, Houston, TX (US)

( * ) Notice: Subject to any disclaimer, the term of this patent is extended or adjusted under 35 U.S.C. 154(b) by 920 days.

(21) Appl. No.: 12/583,368

(22) Filed: Aug. 19, 2009

(65) Prior Publication Data

US 2010/0043416 A1 Feb. 25, 2010

Related U.S. Application Data

(60) Provisional application No. 61/090,844, filed on Aug. 21, 2008.

(51) Int. Cl.
*F04D 29/44* (2006.01)

(52) U.S. Cl.
USPC ..... 415/202; 416/202

(58) Field of Classification Search
USPC ..... 92/261; 415/202; 416/202; 418/49
See application file for complete search history.

(56) References Cited

U.S. PATENT DOCUMENTS

| | | | | |
|---|---|---|---|---|
| 2,097,138 | A | 10/1937 | Steele | |
| 4,235,116 | A | 11/1980 | Meijer | |
| 5,486,142 | A | 1/1996 | Folsom | |
| 5,493,862 | A | 2/1996 | Folsom | |
| 5,524,437 | A | 6/1996 | Larkin | |
| 5,531,072 | A | 7/1996 | Larkin | |
| 5,642,617 | A | 7/1997 | Larkin | |
| 5,896,745 | A | 4/1999 | Folsom | |
| 6,003,480 | A | 12/1999 | Quayle | |
| 6,062,022 | A | 5/2000 | Folsom | |
| 6,248,037 | B1 | 6/2001 | Forster | |
| 6,941,900 | B1 * | 9/2005 | Malinov | 418/49 |
| 7,055,507 | B2 | 6/2006 | Kelley | |

* cited by examiner

*Primary Examiner* — F. Daniel Lopez
(74) *Attorney, Agent, or Firm* — G. Turner Moller

(57) ABSTRACT

A wobble plate motor comprises a rotatable shaft having a bent end rigid with the shaft and an inclined plate journalled on the bent end. When only one side of the inclined plate is directly subjected to high pressure, the plate rolls on a base in the manner of a spinning coin as it decays, i.e. as its spin rate falls to a value where the coin is inclined to the axis of rotation. As the plate rotates, torque is generated on the rotatable shaft so the shaft may drive a work consumer such as a generator, pump or compressor.

14 Claims, 4 Drawing Sheets

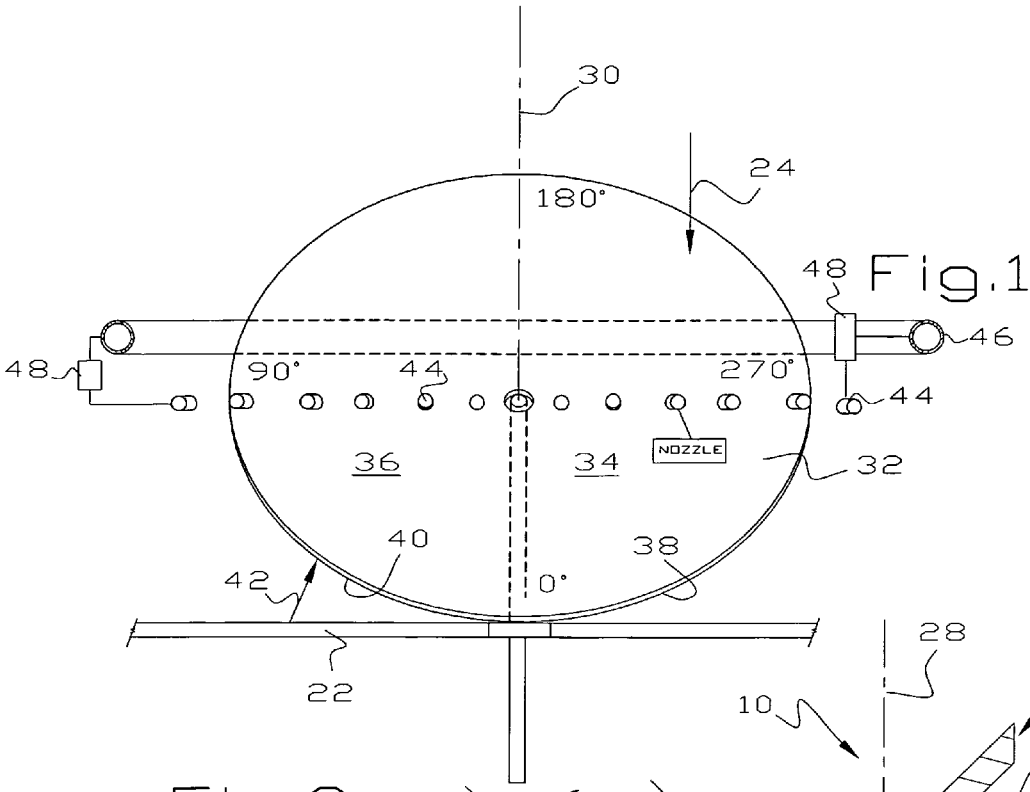
Fig.1
Fig.3
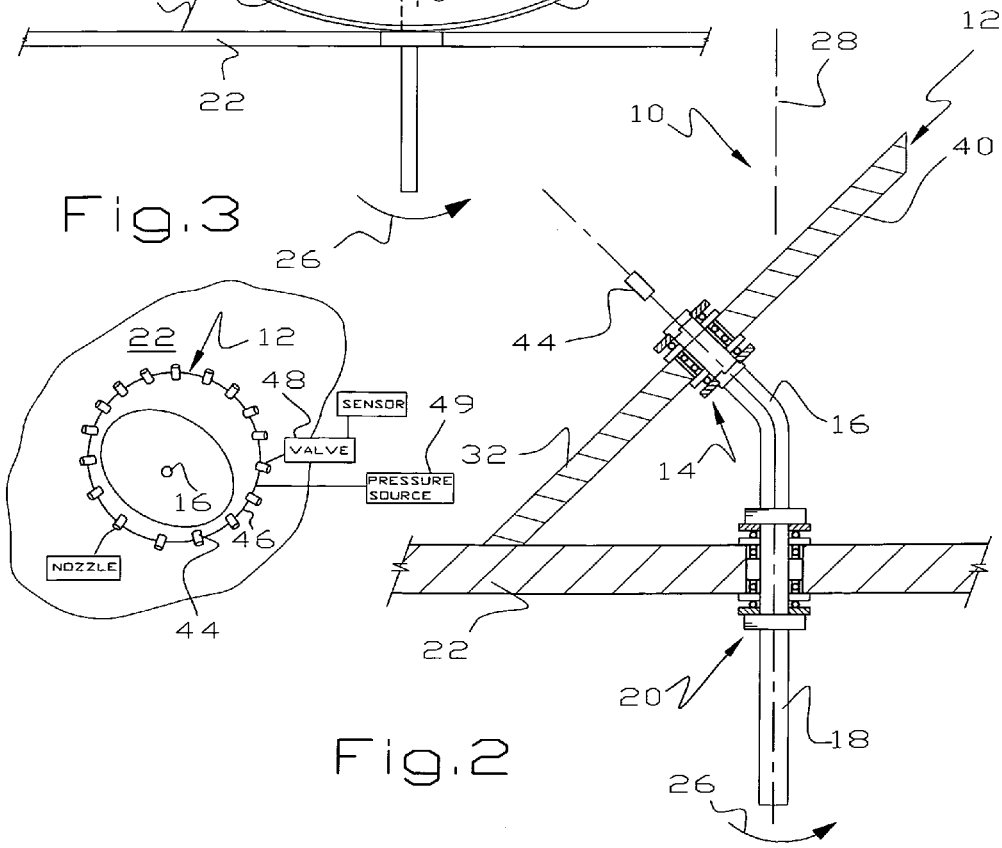
Fig.2

WOBBLE PLATE MOTOR

This invention is based in part on U.S. Provisional Application Ser. No. 61/090,844, filed Aug. 21, 2008, on which priority is claimed.

This invention relates to a wobble plate or swash plate motor and more particularly to such a device in which fluid pressure is applied directly to the wobble plate.

BACKGROUND OF THE INVENTION

Wobble plate or swash plate devices are known in the prior art where the wobble plate comprises a transmission between a device applying a force to the wobble plate and an output device. Thus, wobble plate devices are transmissions between a prime mover and an output device, some of which are pumps. The force applied to the wobble plate is often by a cylinder or piston.

Typical wobble plate devices are found in U.S. Pat. Nos. 2,097,138; 4,235,116; 5,486,142; 5,493,862; 5,524,437; 5,531,072; 5,642,617; 5,896,745; 6,003,480; 6,062,022; 6,248,037 and 7,055,507.

SUMMARY OF THE INVENTION

In one aspect, an inclined plate is mounted on a bent rotatable shaft and subjected to a pressure differential on one or more segments of the plate that induce rotation in the same direction. Thus, in some embodiments, the plate rolls on a base or track and causes rotation of the shaft which may be connected to a work consumer, such as an electrical generator, pump, compressor or the like. When rolling on the track, the inclined plate moves in a manner analogous to a spinning coin as it begins to decay, i.e. when the spin rate slows to a value where the coin is inclined to its axis of rotation. This type motion has been defined as nutation, i.e. the disk nutates.

In some embodiments, the track on which the inclined plate runs is of a non-skid design so the inclined plate does not skid but is, instead, induced to roll on its track. It may be preferred to provide the track and plate with gear teeth providing the non-skid device.

The pressure differential may be applied to the inclined plate in any suitable manner. In one embodiment, nozzles direct a propulsion fluid only onto segments of the plate that drive it in the same direction. In another embodiment, a seal plate overlies the inclined plate and provides an opening exposing one segment of the inclined plate directly to high pressure. A seal between the two plates reduces leaking of the pressure fluid to manageable levels. In a further embodiment, a high pressure fluid is delivered to a compartment overlying the inclined plate. In another embodiment, fluid pressure may be applied directly to the plate by a conduit rotating with the plate.

The motive fluid may be liquid or gas and may preferably be low pressure steam which is available from a variety of industrial sources, such as the exhaust from steam turbines.

It is an object of this invention to provide a wobble plate motor in which an inclined plate is mounted on the end of a bent shaft.

It is an object of this invention to provide a wobble plate motor having surprisingly few moving parts.

Another object of this invention is to provide a wobble plate motor in which a fluid pressure differential is directly applied to only one segment of the wobble plate.

A further object of this invention is to provide a wobble plate motor in which the wobble plate runs on a non-skid track.

These and other objects and advantages of this invention will become more apparent as this description proceeds, reference being made to the accompanying drawings and appended claims.

BRIEF DESCRIPTION OF THE DRAWINGS

FIG. 1 is a front view of one embodiment of a wobble plate motor, certain parts being broken away for clarity of illustration;

FIG. 2 is a cross-sectional view of the motor of FIG. 1, taken in a plane defined by the bent shaft;

FIG. 3 is a schematic top view of the motor of FIGS. 1-2 illustrating one technique for applying fluid pressure to only one side of the inclined plate;

DETAILED DESCRIPTION

Figure 4:
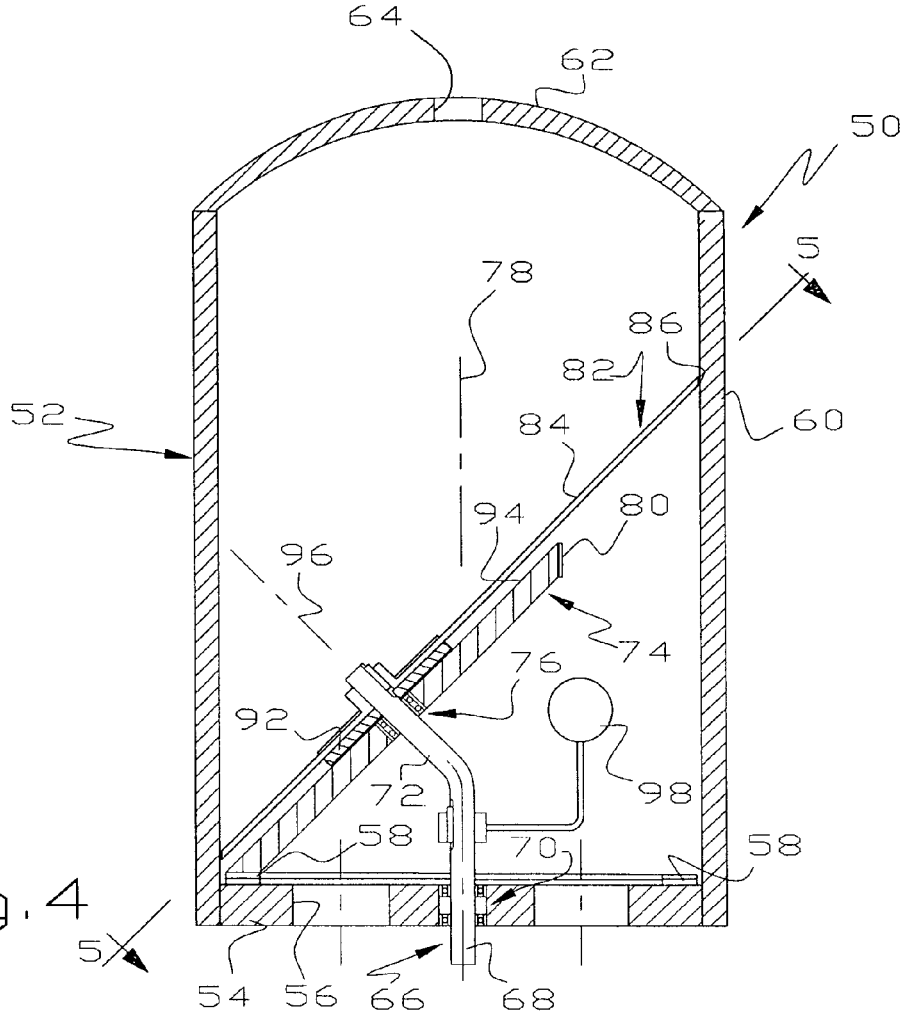
FIG. 4 is a cross-sectional view of another embodiment of a wobble plate motor.

Referring to FIGS. 1-3, there is illustrated a simplified wobble plate motor 10 illustrating its principles of operation. The motor 10 comprises a plate or disk 12 journalled or rotatably mounted by a bearing assembly 14 on a bent end 16 of a shaft 18 rotatably mounted by a bearing assembly 20 in a base 22. If necessary or desirable, the bearing assemblies 14, 20 may include thrust elements to counteract any tendency of the shaft 18 to move axially. The concept is that a force applied to only one segment of the disk 12, as in the direction of the arrow 24, causes the plate 12 to roll on the base 20 and thereby rotate the shaft 18 in the direction shown by the arrow 26 thereby driving an input to a work consumer such as an electrical generator, pump, compressor or the like.

Thus, the plate 12 rotates about an axis 28 of the shaft 18 in a manner analogous to a spinning coin as it begins to decay, i.e. as the spin rate slows to a value where the coin is inclined to its axis of rotation. In other words, the plate 12 nutates as it rolls on a track provided by the base 22.

The force applied to the plate 12 is generated by a differential pressure applied directly to the plate 12 as contrasted to a pressure generated force applied through a cylinder, piston or other mechanical device. Although the differential pressure may be the difference between atmospheric pressure and a partial vacuum, it may be preferred to provide a positive pressure to only one segment of the disk 12 because much greater positive pressures are more readily available and produce much greater torque on the output shaft 18. Although the power fluid may be a liquid, it may be preferred to use a gas, such as steam which is readily available in some industrial environments of which one example is the exhaust from steam turbines.

As shown in FIG. 1, an imaginary plane 30 is defined by the shaft 18 and its bent end 16 to divide a front 32 of the disk 12 into two segments 34, 36 to divide the back of the disk 12 into two segments 38, 40. It will be seen that a force applied in the direction of the arrow 24 to the segment 34 causes the disk 12 to rotate in the direction shown by the arrow 26, as does a force applied to segment 40 in the direction shown by the arrow 42. In other words, forces represented by the arrows 24, 42 cause rotation of the disk 12 in the same direction, i.e. as shown by the arrow 26. Similarly, forces applied to the segments 36, 38 cause rotation of the disk 12 in the direction opposite to the arrow 26. Thus, the segments 34, 40 may be considered complementary or additive and the segments 36, 38 may be considered opposite or subtractive relative to the segments 34, 40. The various segments 34, 36, 38, 40 suggest a myriad of ways in which pressures, or partial vacuums, may be applied to the disk 12 to induce rotation of the shaft 18 in a desired direction.

As used herein, saying that pressure is applied to only one segment of the disk 12 may mean that the disk is subject to greater pressures inducing rotation in one direction rather than in the other direction, such as will occur when high pressure is applied to one segment of the disk 12 and atmospheric pressure is applied to an opposite or subtractive segment.

There are a variety of ways to apply pressure to only one segment of the plate 12 and not to its opposite. As shown in FIG. 1-3, one or more horizontal arrays of nozzles 44 may be supported in any suitable manner, such as on a ring header 46, about the disc 12 so that one or more nozzles 44 is always aimed at or near a given point on the disc 12 such as the imaginary marking 270°. The nozzles 44 are actuated sequentially so that one or more of them discharge power fluid onto the plate 12 toward one or more of the selected plate segments inducing rotation in the desired direction. This may be accomplished in any suitable manner, a simple version of which may be that each nozzle includes a valve 48 having a sensor, such as a feeler, positioned to be tripped by an edge or a detectable marker on the plate 12 as it approaches the nozzle 44 to deliver high pressure fluid from a source 49.

Each of the nozzles 44 is connected by a valve 48 to a pressure source 49 so by judiciously operating selected ones of the valves 48, a high pressure fluid is delivered through the nozzle 44 aimed at the 270° mark, the disk 12 will rotate or nutate about the axis 18 in the direction of the arrow 26. The nozzles 44 may extend completely around the disc 12 as shown in FIG. 3 so one or more of the nozzles 44 aimed at the back 42 of the disk 12 may simultaneously be actuated to deliver power fluid to the back of the imaginary marking 90°, i.e. at the complementary segment 40. This effectively doubles the force applied to the disc 12 and thus doubles the usable output of the shaft 18.

Operation of the motor 10 will now be described. When motive fluid is delivered by the nozzles 44 to the segment 34 and/or to the segment 40, the disc 12 rolls on the base 20 because the pressure and thus the force applied to the complementary disc segments 34, 40 is greater than atmospheric pressure acting on the subtractive segments 36, 38. This rotates the shaft 18 and provides torque and horsepower to operate a work consuming device.

Figure 5:
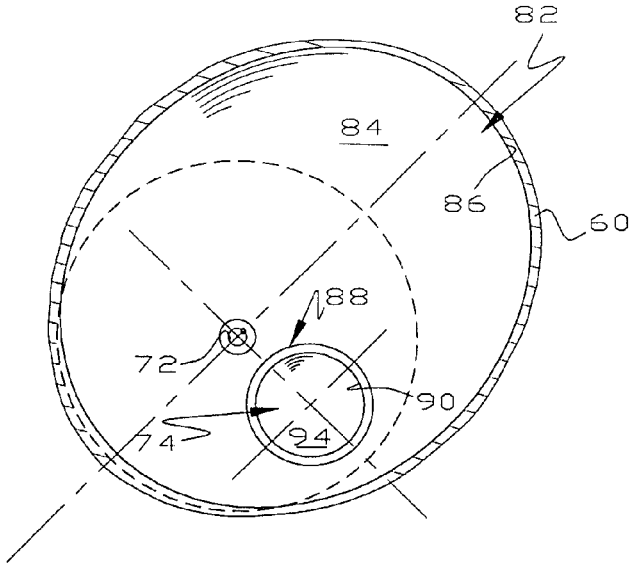
FIG. 5 is a cross-sectional view of the embodiment of FIG. 4, taken substantially along line 5-5 thereof, as viewed in the direction indicated by the arrows.

Referring to FIGS. 4-5, another embodiment of a wobble plate motor 50 comprises a housing 52 including a base 54 having one or more outlet passages 56 open to the atmosphere or other low pressure environment, a track 58 comprising upwardly facing gear teeth, a cylindrical housing 60 and a domed end 62 having a high pressure fluid inlet 64. A shaft 66 includes a straight section 68 mounted by a bearing assembly 70 and includes a bent end 72 rigid with the straight section 68. A pressure plate or disk 74 is mounted by a bearing assembly 76 for rotatable movement about an axis 78 and includes a series of gear teeth 80 meshing with the gear track 58. As in the embodiment of FIGS. 1-3, the bearing assemblies 70, 76 may include thrust elements to counteract any tendency of the shaft 66 to move axially.

In the embodiment of FIGS. 1-3, it will be appreciated that there is a tendency of the pressure plate 12 in the motor 10 to skid on the base 20. To promote rolling movement of the analogous plate 74, a non-skid device may be provided between the plate 74 and the base 54. A non-skid device is intended to mean some mechanism or approach that promotes rolling movement of the plate 74 rather than skidding movement. For example, if the periphery of the plate 74 and its mating surface were smooth, a surface having a higher coefficient of friction than metal-to-metal would constitute a non-skid approach. In the embodiment of FIGS. 4-5, the meshing gears comprise one form of such a non-skid device inducing the plate 74 to roll about the axis 78 rather than having a tendency to skid.

As shown by a comparison of FIGS. 4 and 5, a seal plate 82 rotates synchronously with the pressure plate 74 in any suitable manner. In a simple approach, the seal plate 82 is keyed or otherwise fixed to the bent shaft end 72 so it moves at the same time and at the same rate as the pressure plate 74 moves. Other, more complicated approaches are also feasible. The seal plate 82 may include a generally flat body 84 having a periphery 86 abutting, or nearly abutting, the inside of the housing wall 60 thereby preventing or minimizing the power fluid from leaking around the pressure plate 74. The plate 82 may be provided with suitable seals (not shown) on its perimeter to promote sealing between the plate 82 and the housing 52. The seal plate 82 may be of elliptical shape because the housing wall 60 is illustrated as cylindrical.

The seal plate 82 includes a fitting 88 providing an opening or passage 90 therethrough exposing part of the pressure plate 74 to high pressure admitted through the inlet opening 64. The fitting 88 includes a flange 92 seated against the planar front 94 of the pressure plate 74 to minimize leakage of power fluid between the plates 74, 82. It will be seen that the periphery of the seal plate 82 prevents power fluid from bypassing around the edge of the pressure plate 74 while the fitting 88 prevents substantial leakage between the seal plate 82 and the pressure plate 74. Because only part of the pressure plate 74, on one side of the bent shaft 72, is exposed to high pressure fluid, the plate 74 is induced to roll around the axis 96 of the bent shaft 72 in the same manner as the plate 12 rolls around the axis of the bent shaft 16. It will be apparent that a similar seal plate may be provided on the underside of the pressure plate 74 so high pressure can be applied to complementary segments of the pressure plate 74 provided the gap between the seal plates is open to a low pressure area through which spent motive fluid may escape.

A peculiarity of the motion of the pressure plate 74 and the seal plate 82 is that the area of the pressure plate 74 exposed through the opening 90 does not change. In other words, if one drew an "x" inside the opening 90, it would be visible throughout 360° of rotation of the pressure plate 74 about the axis 78. Thus, the point of application of high fluid pressure to the plate 74 does not change, meaning that the plate 74 is induced to rotate about the axes 96, 78. In other words, if the opening 90 is at the 270° location on the pressure plate 74, it remains at the 270° location.

Because the pressure plate 74 is off center relative to the axis 78, the system is out of balance and prone to vibrate. Thus, it may be desirable to provide a counterweight 98 fixed to the shaft section 66 and at least partially offsetting the out of balance condition of the disc 74.

Operation of the wobble plate motor 50 will now be described. High pressure motive fluid is admitted through the inlet opening 64 and passes through the opening 90 to act on only part of the pressure plate 74, i.e. on one of its complementary segments. The disc 74 rolls on the gear track 58 because the force applied to the complementary disc segments is greater than atmospheric pressure acting on the subtractive segments. This rotates the shaft 66 and provides torque and horsepower to operate a work consuming device.

Figure 6:
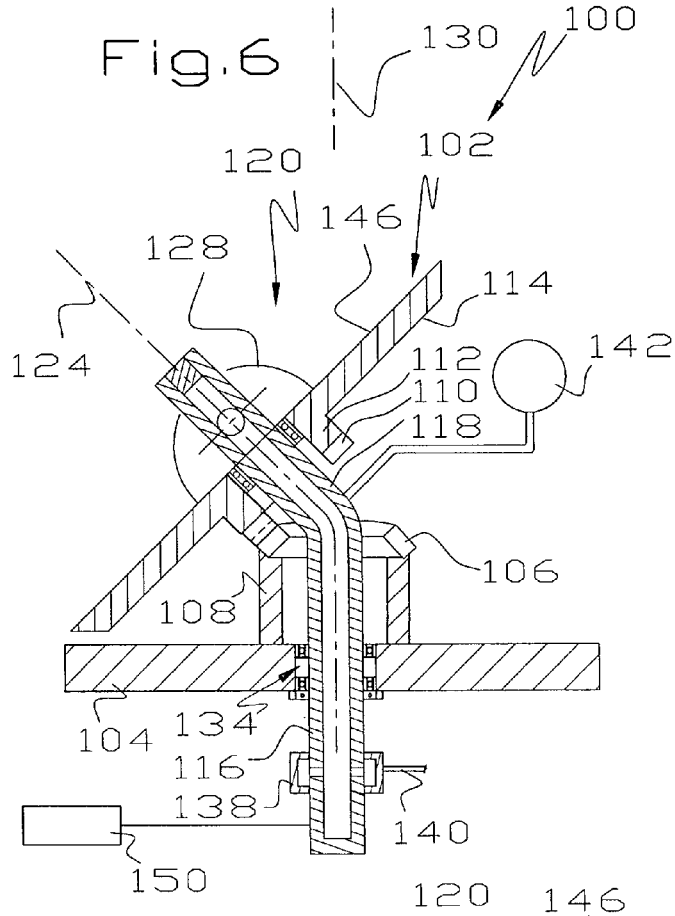
FIG. 6 is a cross-sectional view of another embodiment of a wobble plate motor.
Figure 8:
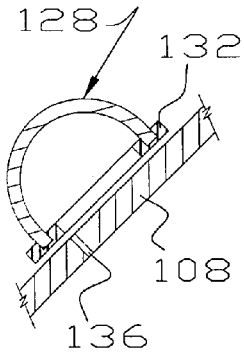
FIG. 8 is a cross-sectional view of the embodiment of FIGS. 6-7, taken substantially along line 8-8 of FIG. 7 as viewed in the direction indicated by the arrows.
Figure 7:
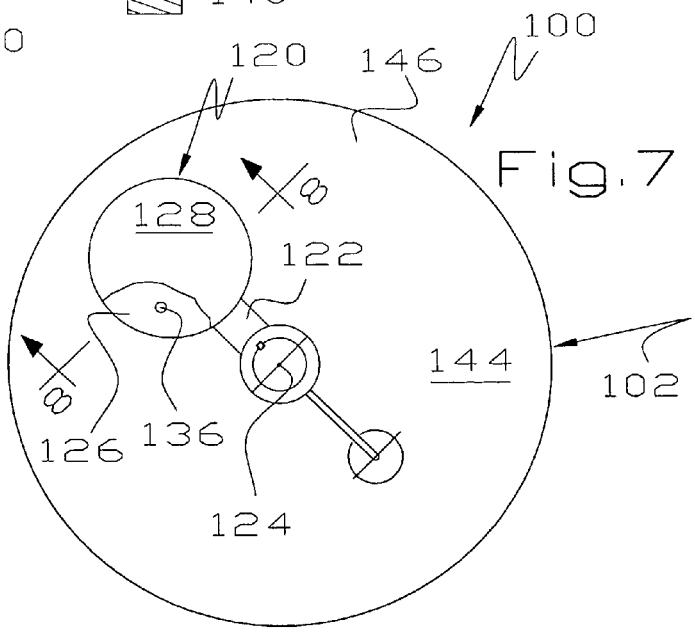
FIG. 7 is a front view of the embodiment of FIG. 6.

Referring to FIGS. 6-8, another embodiment of a wobble plate motor 100 is illustrated. There are two differences between the motors 50, 100, i.e. the plates 78, 102 run on tracks at different radii from the axis of rotation and there is a different technique for applying a pressure differential only to complementary segments of the plates 78, 102.

The motor 100 accordingly includes a base 104 having a gear 106 which may be elevated by a hub 108 above the base 104. A gear 110 of similar size may be mounted on a hub 112 affixed to the back 114 of the plate 102 to mesh with the gear 106. The combined height of the hubs 108, 112 is sufficient to provide the desired angle of inclination of the plate 102. The meshing gears 106, 110 provide a non-skid device for the plate 102.

Instead of a solid shaft, the motor 100 includes a pipe or hollow shaft 116 extending through the hub 108 and having a pipe or hollow bent end 118 rigid with the shaft 116 extending through the hub 114. A power fluid distributor 120 rotates synchronously with the pressure plate 102 and may be fixed to the bent shaft end 118 and includes a conduit 122 communicating with the hollow bent end 118. The conduit 122 extends away from the axis 124 to a location adjacent the plate segment 126 where it is desired to deliver a high pressure fluid. As illustrated in FIGS. 6-8, the pressure plate 102 rotates in a direction opposite from the plates 12, 74 because the plate segment 126 is on an opposite side of the bent shaft end 118.

A dome shaped compartment 128 connects to the conduit 122, communicates with the hollow bent end 118 and terminates immediately above the plate segment 126. If the compartment 128 were fixed to the plate 102, no net force would be applied to the plate 102 because any downward force imparted to the plate 102 would be offset by an equal upward force on the compartment 128 at the same radius from the bent shaft end 118. Thus, the compartment 128 may preferably be attached to the bent shaft end 118 and not to the plate 102. Any force applied to the shaft end 118 by the compartment 128 is applied at the axis 124 while the force applied to the plate segment 126 is at a radius from the axis 124, meaning there is a net torque applied to the plate 102 causing it to rotate about the axis 124 and cause the plate 102 to roll on the gears 106, 110 and an axis 130 of the shaft 116. Thus, there may be some leakage of power fluid from a gap between the plate 102 and the compartment 128. It may be preferred to provide a seal 132 between the plate 102 and the compartment 128 providing the seal 132 is incapable of transmitting a significant tensile force from the compartment 128 to the plate 102. Because the compartment 128 connects to the shaft end 118 through the conduit 122, there may be an upward force applied by the compartment 128 to the shaft 116 which may be overcome in any suitable manner, as by the provision of a thrust element in the bearing assembly 134.

Allowing some leakage between the plate 102 and the compartment 128 may allow some of the power fluid and/or its condensate to escape. In the event a seal 132 is provided between the plate 102 and the compartment 128, it may be desirable to allow leakage of some condensate from the compartment 128, as by the provision of passages 136 through the plate 102. A slip joint 138 on the shaft 116 allows high pressure fluid to pass through a conduit 140 leading from a pressure source and enter the hollow shaft 116 during rotation thereof to maintain a pressure differential only on one segment 126 of the plate 102. A counterweight 142 may be provided to minimize any tendency for the motor 100 to vibrate.

As with the embodiment of FIGS. 5-6, a peculiarity of the motion of the pressure plate 102 is that the location of the area under the compartment 128 does not change. In other words, if one drew an "x" on the pressure segment 126 under the compartment 128, it would not move from under the compartment 128 during 360° of rotation of the pressure plate 102 about the axis 130. Thus, the point of application of high fluid pressure to the plate 102 does not change, meaning that the plate 102 is induced to rotate about the axes 124, 130.

Operation of the motor 100 will now be described. A high pressure fluid is delivered through the conduit 140 and slip joint 138 into the shaft 116 so it passes through the conduit 122 into the compartment 128. This produces high pressure on only one plate segment 126 underlying the compartment 128 and creates a positive pressure differential across the plate 102 because atmospheric pressure is acting on the opposite plate segments 144 on the front 146 of the plate 102. Atmospheric pressure is also acting on the back 114 of the plate 102 but produces no net force tending to rotate the plate 102 about the axis 124 to drive a work consumer 150 such as an electrical generator or the like.

In some embodiments, analogous to FIGS. 6-8, the pressure plate 102 may be fixed to the shaft 116 or the bent shaft end 118 so the plate 102 does not roll, meaning that a track between the plate 102 and the base 104 may be eliminated. It will be seen that, in such an embodiment, a pressure differential applied to the desired plate segment 126 causes the plate 102 to rotate about its axis 130 and thereby drive the work consumer 150.

Figure 9:
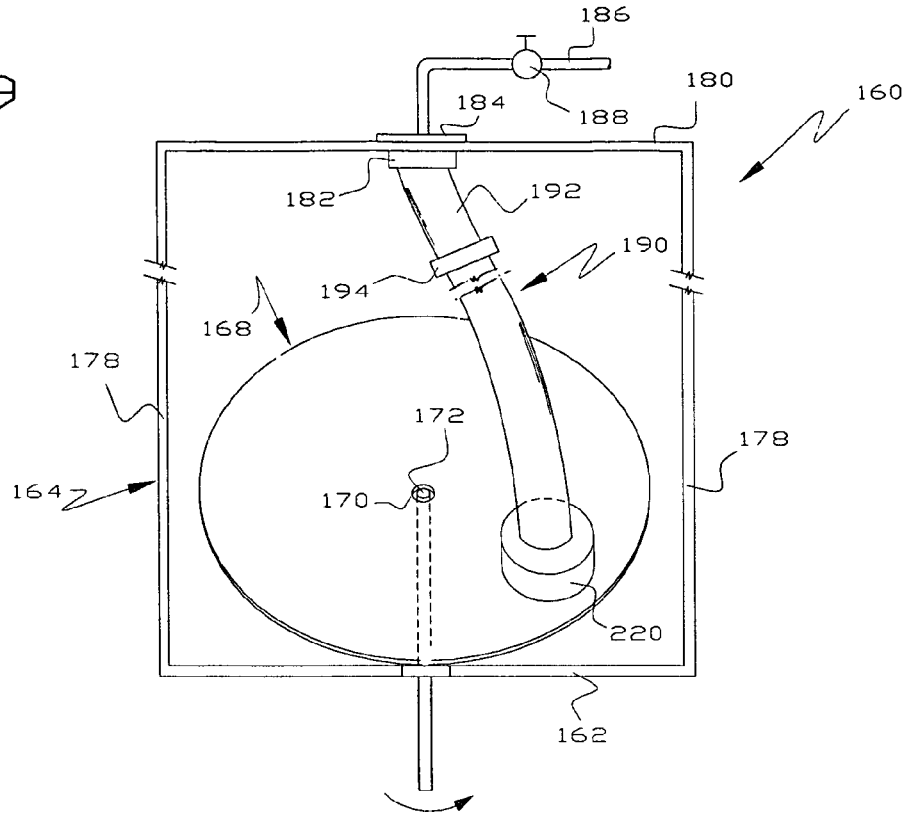
FIG. 9 is a front view of another embodiment of a wobble plate motor.
Figure 10:
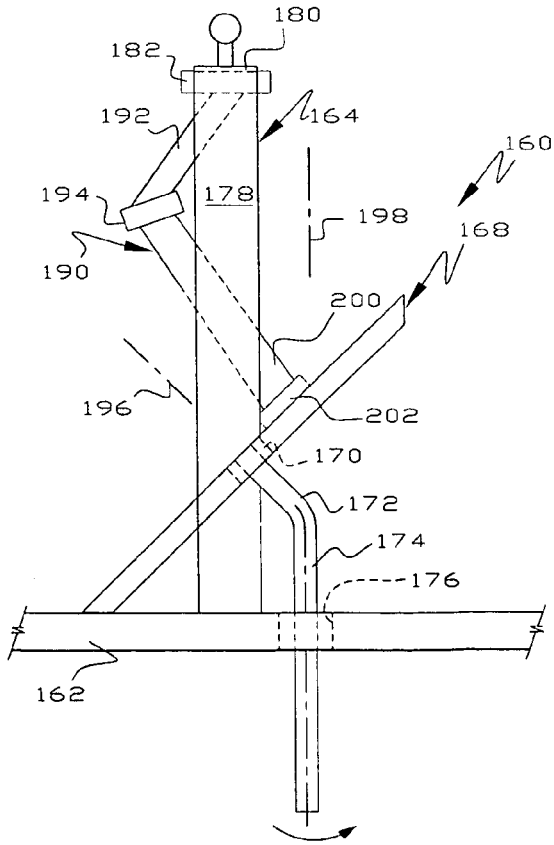
FIG. 10 is a side view of the embodiment of FIG. 9.

Referring to FIGS. 9-10, another wobble plate motor 160 includes a base 162, a support 164 for a power fluid distribution system 166, and an inclined pressure plate 168 rotatably mounted by a bearing 170 on a bent end 172 of a shaft 174 rotatably mounted by a bearing 176 on the base 162. A high friction or no-skid device such as meshing gears may be provided between the plate 168 and the base 162 as in previously described embodiments.

The support 164 may be of any suitable type and is illustrated as including columns 178 and a beam 180 spanning the columns 178. A rotatable sleeve 182 is mounted by a suitable bearing 184 on the beam 180 and connects with a fluid pressure conduit 186 controlled by a valve 188. A flexible conduit 190 has an end 192 mounted on the rotatable sleeve 182 allowing the conduit 190 to rotate relative to the support 164. One or more rotating couplings 194 are spaced along the length of the conduit 190 allowing it to accommodate rolling movement of the pressure plate 168 about the axis 196 as the plate 168 nutates about the axis 198. The bearings 194 are sealed against fluid loss and are of a commercially available type, such as from Deublin Company of Waukegan, Ill. The conduit 190 terminates in an end 200 which is received in a rotating sleeve 202 fixed to one segment of the pressure plate 168. It will be seen that a pressurized fluid admitted through the valve 188 acts only on a segment of the plate 168 under the conduit end 200 thereby producing a net force causing the plate 168 to roll on the base 162. Any opposite force created by the pressurized fluid is delivered to the support 164. In the event it is desired to vent pressurized fluid and/or its condensate through the plate 168, suitable vent passages, analogous to the passages 136, may be provided.

Operation of the motor 160 will now be described. High pressure fluid delivered through the fluid distribution system 166 impinges only on one segment of the pressure plate 168 thereby producing a net force causing the plate 168 to roll around the axis 196 so the plate 168 rolls around the axis 198. The shaft 174 may be connected to a work consumer.

The force produced by pressure acting directly on a surface is the product of the pressure and the area on which the pressure is operating. Using FIGS. 6-8 as an example, a 2' diameter plate 102 in which 300 psig steam can be applied to 80% of the plate on only one side of the bent shaft 118 produces a force of: 300 psi$\times 1^2 \times 3.1416 \times 0.5 \times 0.8$=377 pounds. If the center of the area to which pressure is applied is 4" from the axis 130 of the shaft 116, the torque generated is: 377 pounds×4/12feet=126 foot pounds. By placing another compartment comparable to the compartment 128 on the underside of the plate 102 in the complementary plate segment, the torque is doubled to 252 foot pounds. These torque values are not insignificant considering the maximum torque output of a 2009 Toyota 5.7 liter gasoline engine is 327 foot pounds at 3400 rpm the a maximum torque output of a 2009 Jeep 5.7 liter gasoline engine is 389 foot pounds at 4350 rpm. These engines are, of course, exquisite machines that have benefited from a century of development.

Although the plates 12, 74, 102 are illustrated as circular and the tracks on which they run are illustrated as circular, it will be understood that the plates may be of other shapes provided their abutting tracks compensate for the meandering of the shape of the plates. For example, a plate may be elliptical if its underlying track undulates to accommodate the larger dimension of the plate in one direction and the smaller dimension of the plate in the opposite direction. This accommodation is possible because one salient characteristic of the pressure plates is that the same point on the plate abuts, in the absence of slippage or skidding, the same point on the track during each revolution of the plate.

The inclination of the plates 12, 74, 102, 168 relative to their axes of rotation is subject to considerable variation. If the pressure plates are too flat, too much of the force generated by the application of a differential pressure is applied parallel to the axes of rotation instead of perpendicular to the axes of rotation thereby diminishing the torque and horsepower delivered to the work consumer. Thus, the minimum inclination of the pressure plates depends on how much axial thrust one is willing to put up with. It is easy to imagine embodiments where the pressure plate is essentially upright, so the preferred range of the inclination of the pressure plates may be 20-90°.

An interesting advantage of this invention is the relative paucity of moving parts. There are only the pressure plate, the shaft on which it is mounted, the bearings that accommodate movement and moving parts that relate to the delivery of pressure to the high pressure segment.

Although this invention has been disclosed and described in its preferred forms with a certain degree of particularity, it is understood that the present disclosure of the preferred forms is only by way of example and that numerous changes in the combination and arrangement of parts, as well as the details of the components, may be resorted to without departing from the spirit and scope of the invention as hereinafter claimed.

I claim:

1. A wobble plate motor comprising a shaft having a first section mounted for rotation about an axis and a bent end, rigid with the first section, inclined to the rotational axis, a base, a plate inclined to the rotational axis, journalled on the bent end for rotation therearound, and having a high pressure segment on one side of the bent end and a low pressure segment on an opposite side of the bent end, the plate abutting the base so high pressure applied to only the high pressure segment causes rolling movement of the plate on the base, and equipment applying a fluid pressure differential directly to the high pressure segment, the equipment comprising a source of fluid pressure, a series of spaced fluid nozzles mounted about a periphery of the plate and aimed at the plate, each nozzle including a valve controlling flow from the source of fluid pressure and a sensor detecting the high pressure segment and sequentially opening the valves and thereby directing fluid from the source of fluid pressure onto the high pressure segment whereby the plate rolls on the base and rotates the first shaft section.

2. The wobble plate motor of claim 1 further comprising a work consumer driven by the shaft.

3. The wobble plate motor of claim 1 wherein the plate includes a front having a high pressure segment on a first side of the bent shaft and a low pressure segment on a second side of the bent shaft, a back having a high pressure segment on the second side of the bent shaft and a low pressure segment on the first side of the bent shaft, and the equipment applying a fluid pressure differential directly to the high pressure segment applies fluid pressure differential to at least one of the high pressure segments.

4. The wobble plate motor of claim 3 wherein the source of high pressure is applied to both of the high pressure segments.

5. The motor of claim 1 further comprising a ring surrounding the disc, the nozzles being mounted on the ring.

6. The motor of claim 5 wherein the ring comprises a tube, the source of fluid pressure being connected to the tube, the tube being in fluid communication with each nozzle through one of the valves.

7. A wobble plate motor comprising a shaft having a first section mounted for rotation about an axis and a bent end rigid with the first section and inclined to the rotational axis, a plate inclined to the rotational axis and mounted on the bent shaft end, a base, and equipment applying a fluid pressure directly to a high pressure segment of the plate on one side of the bent shaft end, the equipment comprising a source of fluid pressure, a series of spaced fluid nozzles mounted about a periphery of the plate and aimed at the plate, each nozzle including a valve controlling flow from the source of fluid pressure and a sensor detecting the high pressure segment and sequentially opening the valves and thereby directing fluid from the source of fluid pressure onto the high pressure segment whereby the plate rolls on the base and rotates the first shaft section.

8. The wobble plate motor of claim 7 wherein the plate includes a front having a high pressure segment on a first side of the bent shaft and a low pressure segment on a second side of the bent shaft, a back having a high pressure segment on the second side of the bent shaft and a low pressure segment on the first side of the bent shaft, and the equipment applying fluid pressure directly to the high pressure segment applies fluid pressure to at least one of the high pressure segments.

9. The motor of claim 7 further comprising a ring surrounding the disc, the nozzles being mounted on the ring.

10. The motor of claim 9 wherein the ring comprises a tube, the source of fluid pressure being connected to the tube, the tube being in fluid communication with each nozzle through one of the valves.

11. A motor having a rotatable shaft providing a bent end rigid with the shaft, a base, a plate inclined to the base, journalled on the bent end and rolling on the base, and equipment applying fluid pressure directly on at least one high pressure segment of the plate, the equipment comprising a source of fluid pressure, a series of spaced apart fluid nozzles mounted about a periphery of the plate and aimed at the plate, each nozzle including a valve controlling flow from the source of fluid pressure and a sensor detecting the at least one high pressure segment and sequentially opening the valves and thereby directing fluid from the source of fluid pressure onto the high pressure segment whereby the plate nutates on the base.

12. The motor of claim 11 wherein the plate includes a front having a high pressure segment on a first side of the bent shaft and a low pressure segment on a second side of the bent shaft, a back having a high pressure segment on the second side of the bent shaft and a low pressure segment on the first side of the bent shaft, and the equipment applying fluid pressure directly to the high pressure segment applies pressure to at least one of the high pressure segments.

13. The motor of claim 11 further comprising a ring surrounding the disc, the nozzles being mounted on the ring.

14. The motor of claim 13 wherein the ring comprises a tube, the source of fluid pressure being connected to the tube, the tube being in fluid communication with each nozzle through one of the valves.

* * * * *